US009004938B2

(12) United States Patent
Chang

(10) Patent No.: US 9,004,938 B2
(45) Date of Patent: Apr. 14, 2015

(54) ELECTRICAL CONNECTOR ASSEMBLY

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 44 days.

(21) Appl. No.: 13/895,912

(22) Filed: May 16, 2013

(65) Prior Publication Data

US 2014/0065848 A1 Mar. 6, 2014

(30) Foreign Application Priority Data

Aug. 29, 2012 (TW) ..... 101216598 A

(51) Int. Cl.

| | |
|---|---|
| ***H01R 13/60*** | (2006.01) |
| ***H01R 12/50*** | (2011.01) |
| ***H01R 12/71*** | (2011.01) |
| *H01R 12/73* | (2011.01) |

(52) U.S. Cl.

CPC ..... *H01R 12/50* (2013.01); *H01R 12/716* (2013.01); *H01R 12/737* (2013.01)

(58) Field of Classification Search

CPC ..... H01R 23/7073

USPC ..... 439/541.5, 79

See application file for complete search history.

(56) References Cited

U.S. PATENT DOCUMENTS

| | | | | |
|---|---|---|---|---|
| 5,080,609 | A * | 1/1992 | Fabian et al. | 439/541.5 |
| 7,874,868 | B2 * | 1/2011 | Chang | 439/540.1 |

* cited by examiner

*Primary Examiner* — Phuong Dinh

(74) *Attorney, Agent, or Firm* — Muncy, Geissler, Olds & Lowe, P.C.

(57) ABSTRACT

An electrical connector assembly for electrically connecting an external circuit board has an insulating main body, a first connector module, a second connector module and a flexible conducting wire. The first connector module is disposed inside the insulating main body and electrically connected to the external circuit board. The second connector module is disposed inside the insulating main body and located above the connector module. The flexible conducting wire has two ends electrically connected to the second connector module and the external circuit board. The flexible conducting wire replaces a traditional metal conducting pin, so as to achieve simple process and decrease electromagnetic interference.

6 Claims, 7 Drawing Sheets

ELECTRICAL CONNECTOR ASSEMBLY

BACKGROUND OF THE INVENTION

1. Field of the Invention

The present invention relates to an electrical connector assembly, in particular, to an electrical connector assembly having a flexible conducting wire.

2. Description of Related Art

Followed by rapid technology development, various kinds of electrical connector assemblies have been invented for electrical connection between electronic components and circuit boards. In order to decrease an occupied bottom surface of an electrical connector assembly and to increase the quantity of an electrical connector, the industry vents a stacked electrical connector assembly having a plurality of vertically stacked electrical connectors.

According to the present technique level, the stacked electrical connector assembly has a lower electrical connector. The lower electrical connector has conducting pins capable of electrically inserting downward into an external circuit board in a very short distance. In the contrast, the stacked electrical connector assembly has an upper electrical connector. The upper electrical connector has conducting pins capable of electrically inserting backward and downward into the external circuit board in a bend sate and a very long distance.

However, the conducting pin is made from a metal material with high conductivity and thus has certain rigidity. In an actual process, a fixture has to be used to produce the conducting pin of the upper electrical connector with a correct extension length and bend distance. Since each kind of the electrical connector has the conducting pin with different quantity and length, a different fixture has to be designed, such that process complexity and cost may be increased.

Further, since the metal conducting pin does not have flexibility, precise alignment has to be made between the conducting pin and a socket of the external circuit board without errors. Once the angle or location of the conducting pin is incorrect, the yield of the whole electrical connector assembly will be affected.

On other hand, since the traditional metal conducting pin lacks flexibility, once the electrical connector assembly is crashed or vibrated, the conducting pin could crack. Moreover, the metal conducting pin may also be suffered to electromagnetic interference (EMI). Therefore, the conducting pin should be cover by a metal shield body, so as to reduce the effect of electromagnetic interference.

Hence, the objective of the present invention is to solve the above-mentioned problems.

SUMMARY OF THE INVENTION

Figure 1:
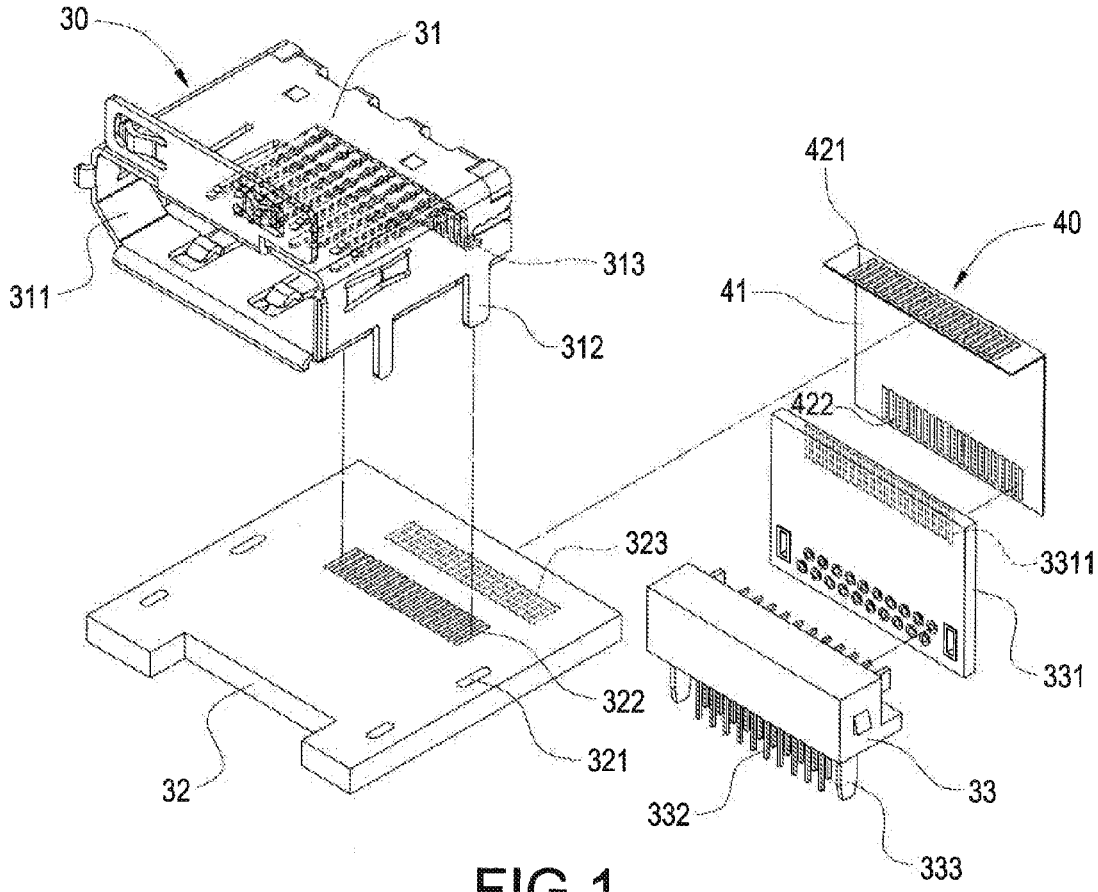
FIG. 1 is a partially perspective disassembly view according to the present invention.

One objective of the present invention is to provide an electrical connector assembly having advantages of easy manufacturing, none fixture, and cost down.

Another objective of the present invention is to provide an electrical connector assembly having a wide range of assembly flexibility, hard to fracture, and capable of decreasing electromagnetic interference simultaneously.

In order to achieve the above-mention objectives, the present invention provides an electrical connector assembly for electrically connecting an external circuit board comprising:

an insulating main body;

a first connector module disposed inside the insulating main body and electrically connected to said external circuit board;

at least one second connector module disposed inside the insulating main body and located above the first connector module; and a flexible conducting wire having two ends electrically connected to the second connector module and said external circuit board, respectively.

In comparison with the related art, the present invention has the following effects:

In the present invention, the electrical connector assembly has the second connector module located above the first connector module, and the second connector module is electrically connected to the external circuit board via the flexible conducting wire, so as to replace a traditional metal conducting pin. The flexible conducting wire can be a flexible flat cable (FFC) or a general electrical cable, such that when the second connector module is electrically connected. to the external circuit board, flexible conducting wires have different quantity of conductive terminals can be easily manufactured without any fixture. Accordingly, it can significantly achieve cost down and simplify process.

Further, flexibility of the flexible conducting wire can significantly decrease precision requirement between the second connector module and the external circuit board, so as to simplify assembly process and increase yield of the entire electrical connector assembly. In addition, the flexible conducting wire can absorb external impact or vibration, so as to decrease fracture probability of the conductive terminal.

Moreover, either of the flexible flat cable and the general electrical cable has an insulation cladding layer disposed on a surface thereof, such that the problem of electromagnetic interference can be solved at the same time. Hence, the present invention. can achieve a lot of functions, and thus has obviousness and usability.

DETAILED DESCRIPTION OF THE INVENTION

The detailed description and the technical content of the present invention are illustrated along with the accompanied drawings as follows. The accompanied drawings merely provide reference and description instead of a limit to the present invention.

Please refer to FIG. 1 to FIG. 5, the present invention provides an electrical connector assembly 1 for electrically connecting an external circuit board (not shown). Persons skilled in the art can understand the external circuit board not illustrated in the drawings of the present invention.

In the present invention, the electrical connector assembly 1 comprises an insulating main body 10, a first connector module 20, at least one second connector module 30, and a flexible conducting wire 40.

Figure 3:
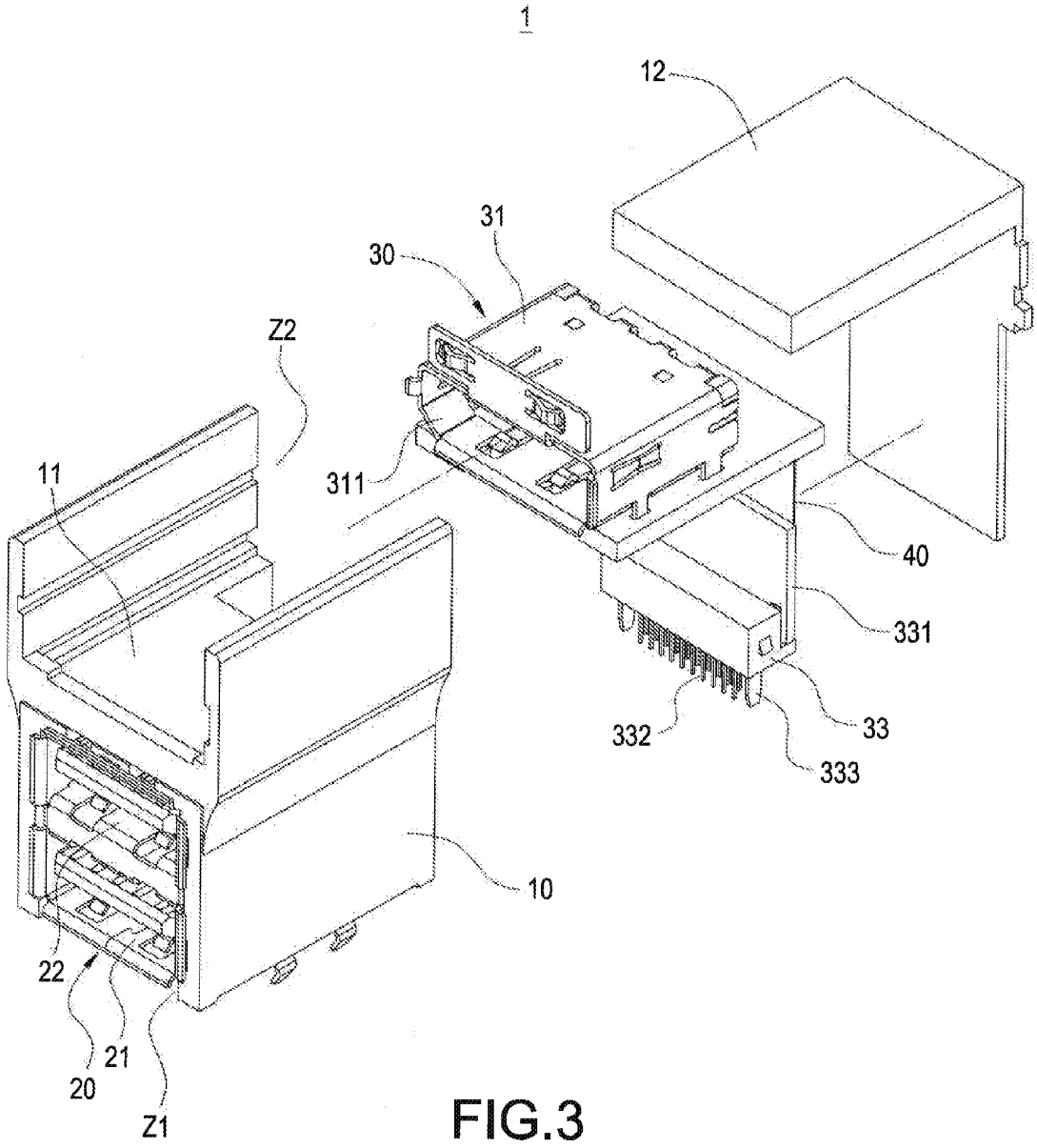
FIG. 3 is a perspective disassembly view according to the present invention.
Figure 4:
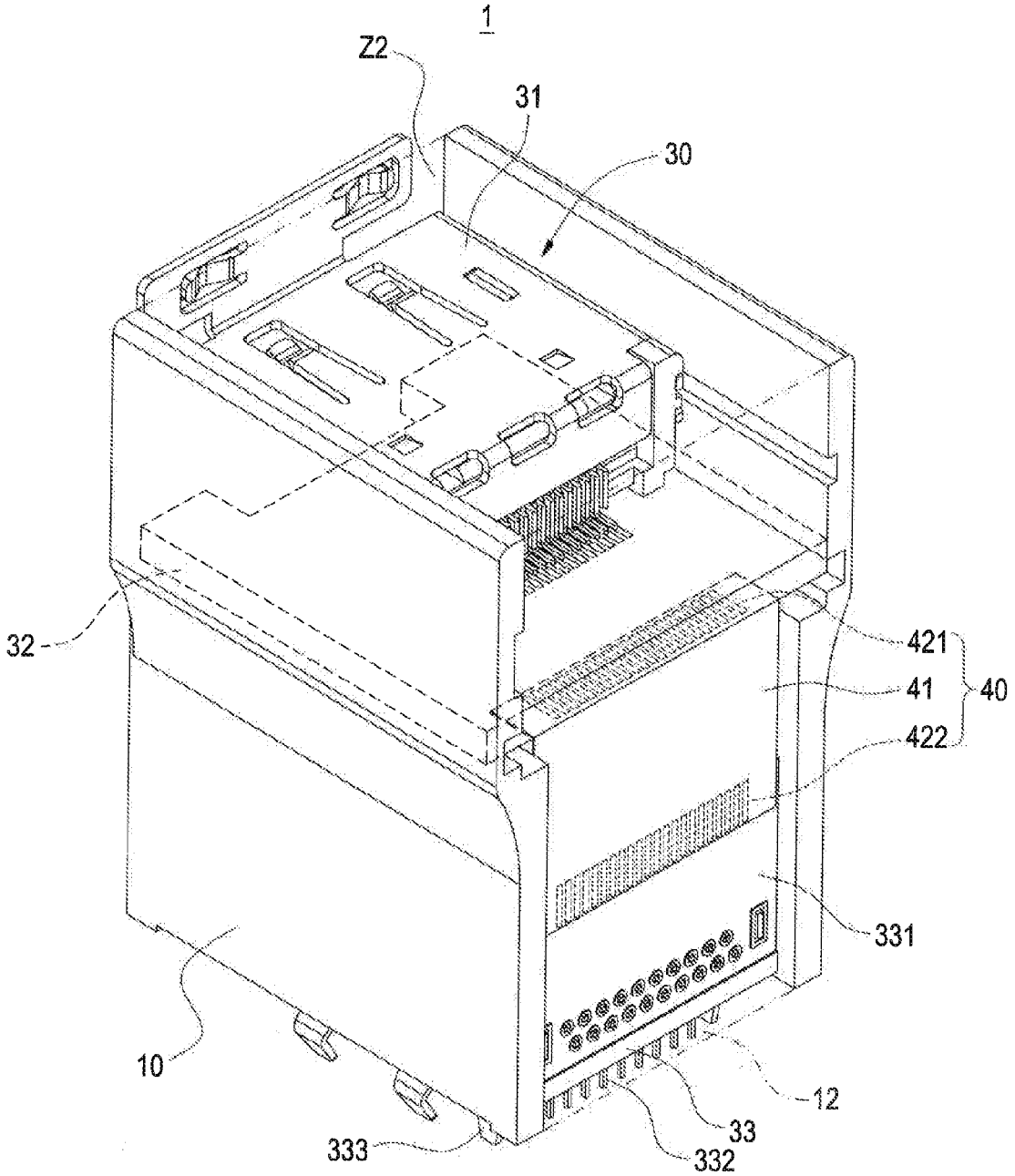
FIG. 4 is a perspective assembly view according to the present invention.
Figure 5:
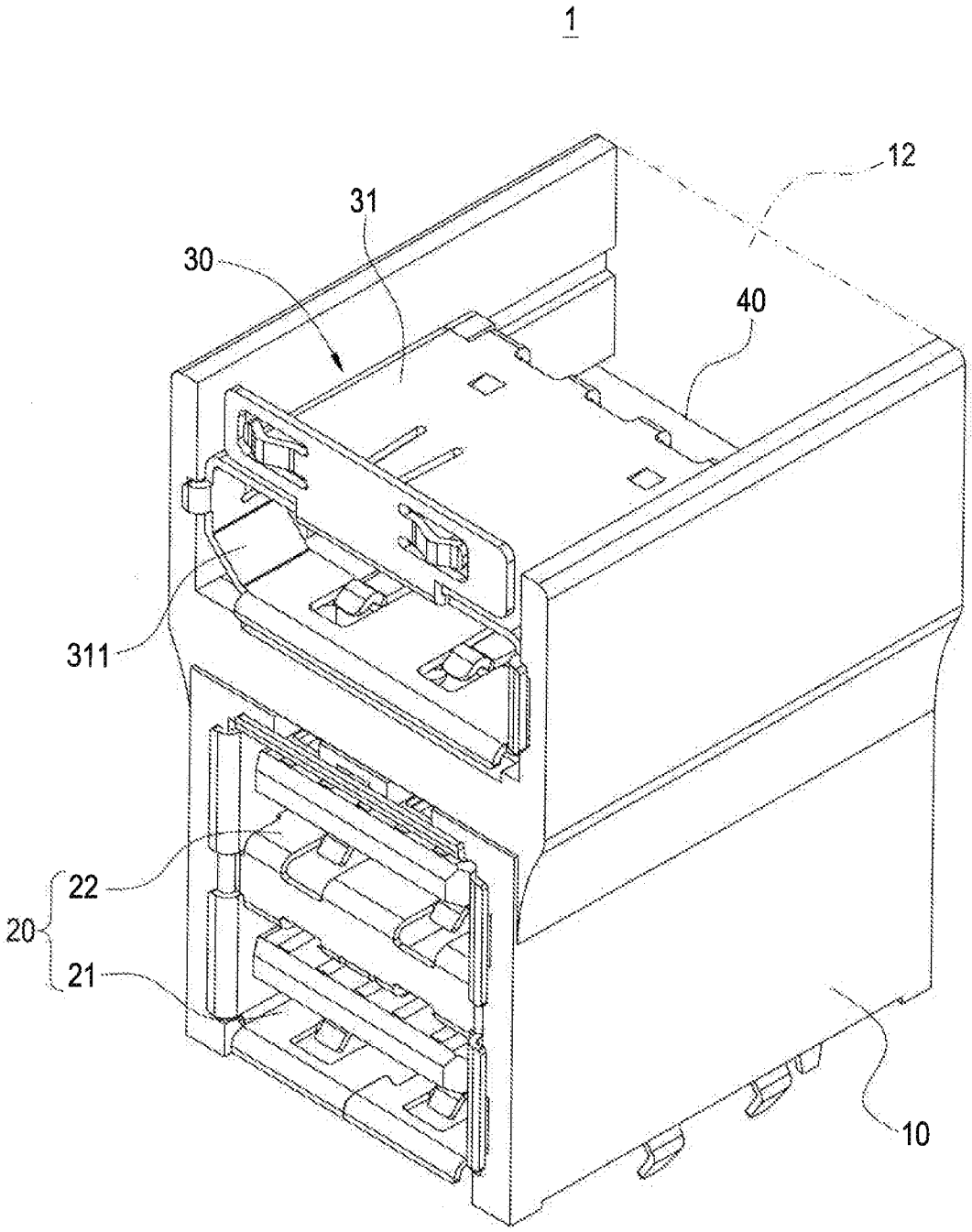
FIG. 5 is a perspective assembly view according to the present invention.

As illustrated in FIG. 3, the insulating main body 10 is generally of H-shape and has a horizontal partition board 11. The insulating main body 10 has a first accommodation space Z1 located below the horizontal partition board 11 and a second accommodation space Z2 located above the horizontal partition board 11. The first connector module 20 is disposed inside the first accommodation space Z1. The second connector module 30 is disposed inside the second accommodation space Z2. Accordingly, the second connector module 30 is disposed inside the insulating main body 10 and located above the first connector module 20.

In the embodiment of the present invention, the first connector module 20 has, but not limited to, two vertically stacked connectors 21, 22. The first connector module 20 can has only one connector. The connectors 21, 22 of the first connector module 20 are electrically connected to the external circuit board by a traditional method. Its structure and electrical connection method are not technical features of the present invention, and thus are ignored for avoiding redundancy.

Figure 2:
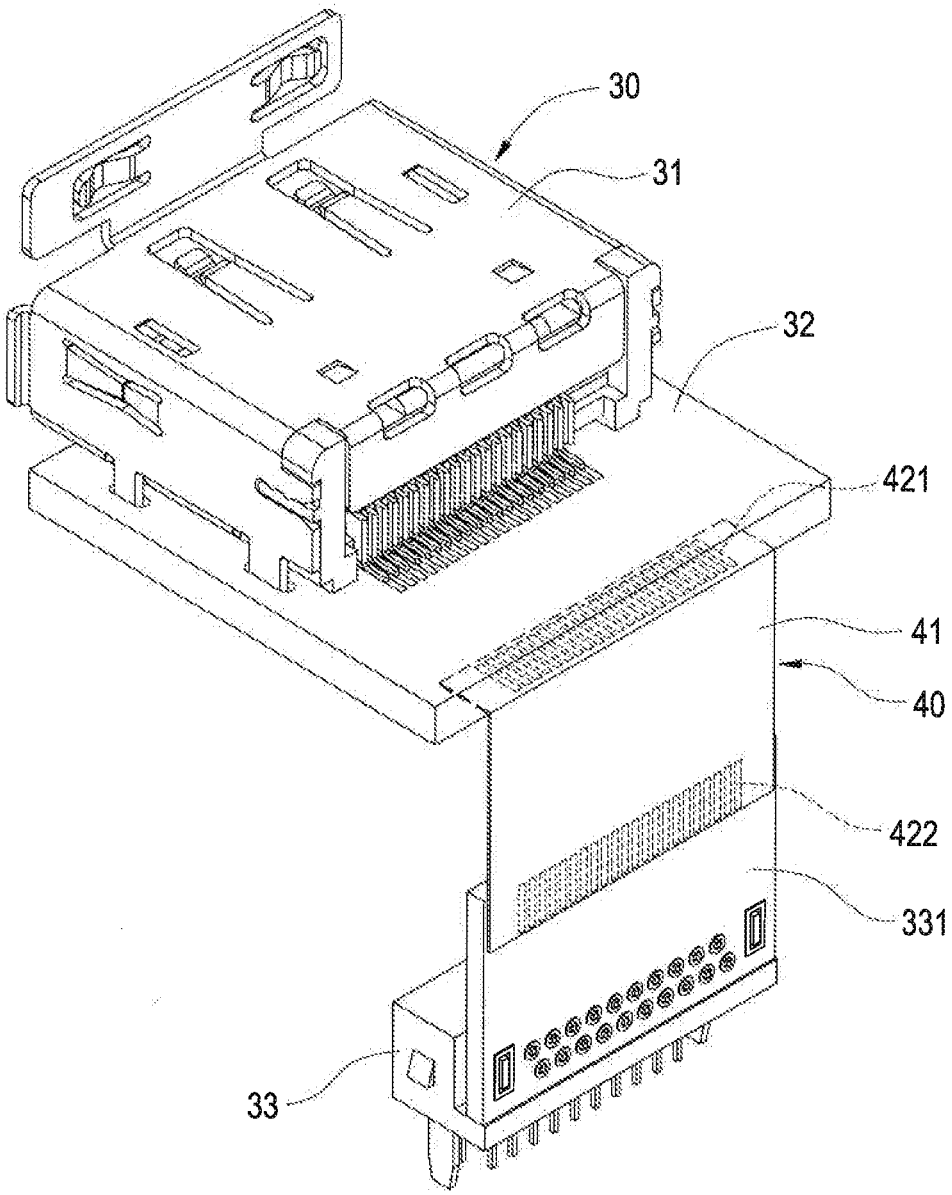
FIG. 2 is a partially perspective assembly view according to the present invention.

As illustrated in FIG. 1 and FIG. 2, the second connector module 30 comprises a metal housing 31, an internal circuit board 32, and a terminal group 33.

The metal housing 31 has a front socket 311 for insertion of a corresponding male connector (not shown). The metal housing 31 has a plurality of fixing pins 312 extending downward from two sides thereof for fixing a plurality of insertion holes 321 of the internal circuit board 32. The metal housing 31 has a plurality of conductive terminals 313 extending downward from a bottom thereof for electrically connecting a plurality of conduction layers 322 of the internal circuit board 32.

The internal circuit board 32 is disposed on the horizontal partition board 11 of the insulating main body 10, and the internal circuit board 32 has a plurality of connection terminals 323 (so called as "golden finger") formed on a rear end thereof.

As illustrated in the embodiment of FIG. 1, the flexible conducting wire 40 is a flexible flat cable (FFC). The flexible flat cable has an insulation cladding layer 41 and a plurality of core wires disposed inside the insulation cladding layer. The flexible flat cable 40 has two golden fingers 421, 422 formed on two ends thereof for electrically connecting the internal circuit board 32 and connection terminals 332, 3311 disposed on an end of a conduction board 331 of the terminal group 33. Another end of the conduction board 331 is electrically connected to the terminal group 33. The second connector module 30 can be electrically connected to the external circuit board via combination of the flexible flat cable 40, the conduction board 331 and the terminal group 33.

As illustrated in FIG. 3, after the second connector module 30 achieves electrical connection, a protection cover 12 can selectively cover above and behind the insulating main body 10, so as to protect the flexible flat cable 40 and electronic components inside the flexible flat cable 40.

Figure 6:
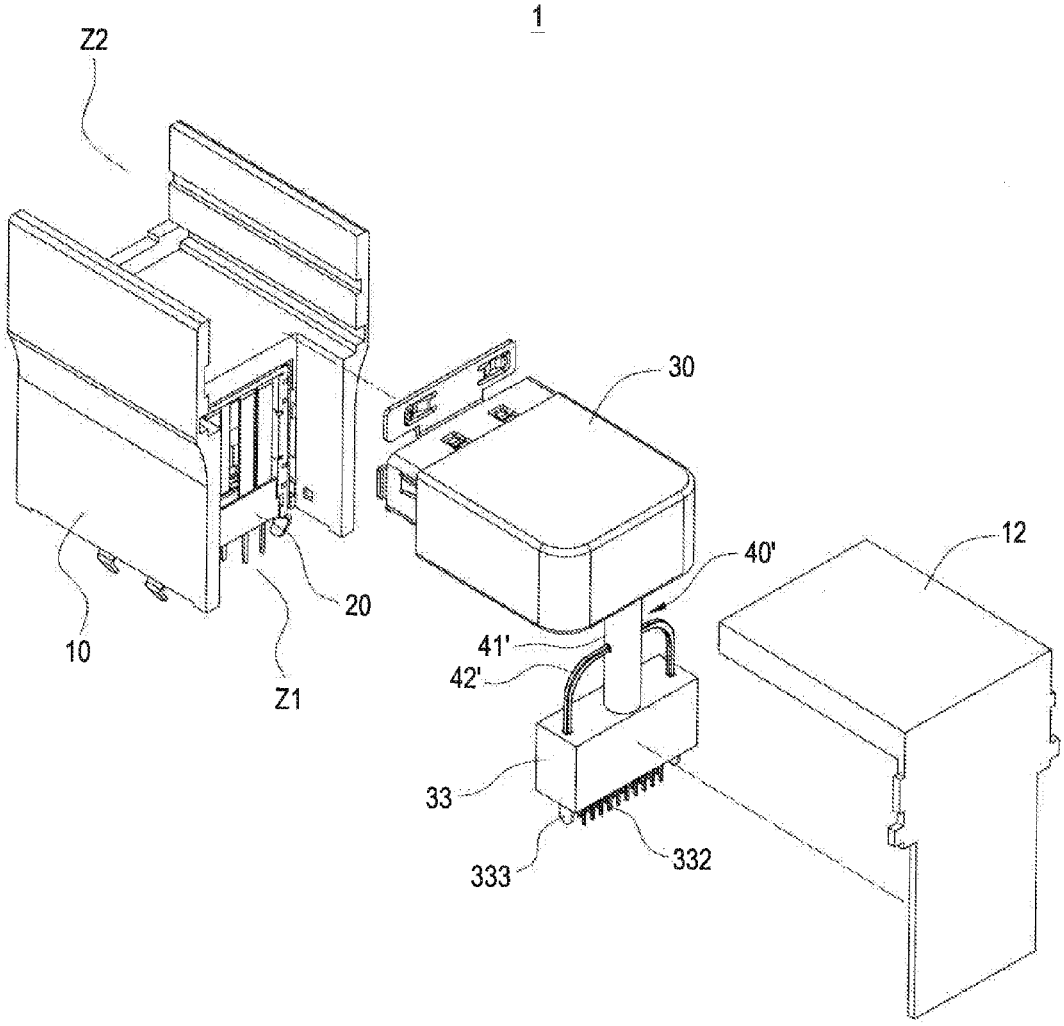
FIG. 6 is a perspective disassembly view according to another embodiment of the present invention.
Figure 7:
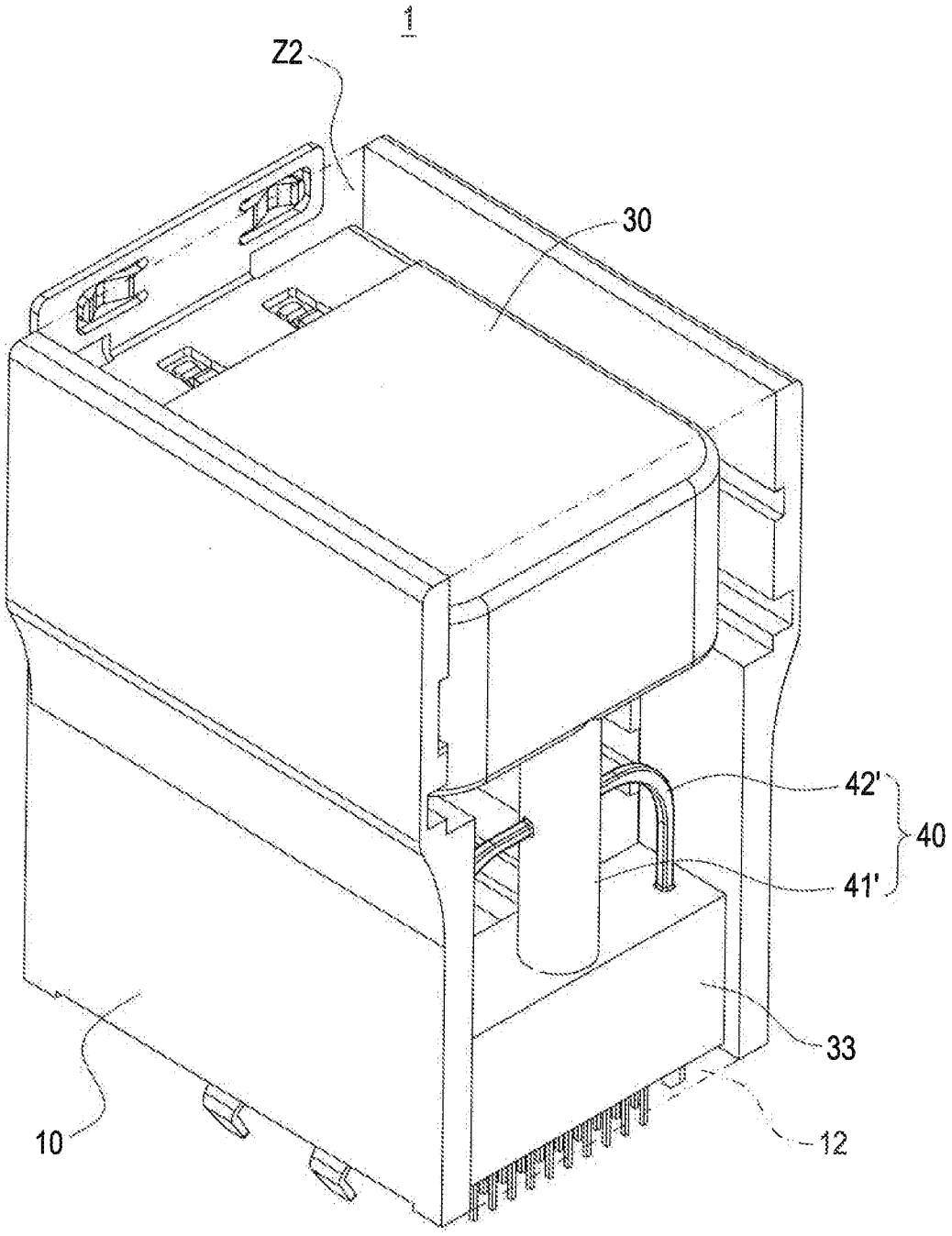
FIG. 7 is a perspective assembly view according to another embodiment of the present invention.

As illustrated in another embodiment of the present invention of FIG. 6 and FIG. 7, this embodiment differs from the previous embodiment in that the flexible conducting wire 40' is a general electrical cable. The flexible conducting wire 40 has an insulation cladding layer 41' and a plurality of core wires (not shown) located inside the insulation cladding layer 41', The conducting wire has two ends electrically connected to the conductive terminal inside the second connector module 30 and the connection terminal 332 inside the terminal group 33, such that the second connector module 30 is electrically connected to the external circuit board. In addition, the electrical cable 40' can have two grounding wire 42', so as to directly and electrically connecting a grounding terminal 333 of the terminal group 33.

Similarly, after the second connector module 30 achieves electrical connection, a protection cover 12 can selectively cover above and behind the insulating main body 10, so as to protect the electrical cable 40' and electronic components inside the electrical cable 40'.

In the embodiment of the present invention, the second connector module 30 has, but not limited to, only one connector. The second connector module 30 can has more than two connectors each of which is electrically connected to the external circuit board by the flexible conducting wire.

In comparison with the related art, the present invention has the following effects: In the present invention, the electrical connector assembly I has the second connector module 30 located above the first connector module 20, and the second connector module 30 is electrically connected to the external circuit board via the flexible conducting wire 40, so as to replace a traditional metal conducting pin. The flexible conducting wire 40 can be the flexible flat cable or the electrical cable, such that when the second connector module 30 is electrically connected to the external circuit board, flexible conducting wires 40 have different quantity of conductive terminals can be easily manufactured without any fixture. Accordingly, it can significantly achieve cost down and simplify process.

Further, flexibility of the flexible conducting wire 40 can significantly decrease precision requirement between the second connector module 30 and the external circuit board, so as to simplify assembly process and increase yield of the entire electrical connector assembly 1. In addition, the flexible conducting wire 40 can absorb external impact or vibration, so as to decrease fracture probability of the conductive terminal.

Moreover, either of the flexible flat cable and the general electrical cable has the insulation cladding layer disposed on a surface thereof, such that the problem of electromagnetic interference can be solved at the same time. Hence, the present invention can achieve a lot of functions, and thus has obviousness and usability.

In conclusion, the electrical connector assembly according to the present invention has industrial applicability, novelty and non-obviousness. The present invention is neither disclosed by similar products nor used in public, and totally complies with application requirements for a Utility Model patent, such that an application is filed pursuant to the Patent Law.

What is claimed is:

1. An electrical connector assembly for electrically connecting an external circuit board, comprising:

an insulating main body;

a first connector module disposed inside the insulating main body and electrically connected to the external circuit board;

at least one second connector module disposed inside the insulating main body and located above the first connector module; and a flexible conducting wire having two ends electrically connected to the second connector module and the external circuit board, respectively;

wherein the second connector module further including an internal circuit board and a terminal group electrically connected to the external circuit board, and the internal circuit board has a plurality of connection terminals, the terminal group has a conduction board having connection terminals;

wherein the flexible conducting wire is disposed outside of the insulating main body, two ends of the flexible conducting wire are electrically connected to the internal circuit board and the connection terminals respectively.

2. The electrical connector assembly of claim 1, wherein the flexible conducting wire is a flexible flat cable, and the flexible conducting wire has a flexible insulation cladding layer and a plurality of core wires located inside the flexible insulation cladding layer.

3. The electrical connector assembly of claim 1, wherein the flexible conducting wire is an electrical cable, and the flexible conducting wire has a flexible insulation cladding layer and a plurality of core wires located inside the flexible insulation cladding layer.

4. The electrical connector assembly of claim 1, wherein the insulating main body is of H-shape, the insulating main body has a horizontal partition board, the insulating main body has a first accommodation space located below the horizontal partition board and a second accommodation space located above the horizontal partition board, the first connector module is disposed inside the first accommodation space, and the second connector module is disposed inside the second accommodation space.

5. The electrical connector assembly of claim 4, wherein the second connector module comprises a metal housing, the metal housing has a front socket, the metal housing has a plurality of fixing pins extending downward from two sides thereof for fixing to a plurality of insertion holes of the internal circuit board, the metal housing has a plurality of conductive terminals extending downward from a bottom thereof for electrically connecting a plurality of conduction layers of the internal circuit board, and the internal circuit board is disposed on the horizontal partition board.

6. The electrical connector assembly of claim 1, wherein the insulating main body is capable of selectively being covered by a protection cover, and the protection cover covers and protects the flexible conducting wire and an electronic component inside the insulating main body.

* * * * *